US010370782B1

(12) United States Patent
Blakely et al.

(10) Patent No.: US 10,370,782 B1
(45) Date of Patent: Aug. 6, 2019

(54) ARTICLE OF APPAREL

(71) Applicant: Under Armour, Inc., Baltimore, MD (US)

(72) Inventors: Kyle Blakely, Baltimore, MD (US); Randy Harward, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 20 days.

(21) Appl. No.: 15/150,206

(22) Filed: May 9, 2016

Related U.S. Application Data

(60) Provisional application No. 62/158,706, filed on May 8, 2015.

(51) Int. Cl.
*D04B 1/18* (2006.01)
*D04B 1/24* (2006.01)
*D04B 1/14* (2006.01)

(52) U.S. Cl.
CPC ..... *D04B 1/18* (2013.01); *D04B 1/14* (2013.01); *D04B 1/246* (2013.01); *A41D 2500/10* (2013.01)

(58) Field of Classification Search
CPC ... D04B 1/16; D04B 1/18; D04B 1/20; D04B 1/12; D04B 1/246; D04B 1/14; D04B 1/04
See application file for complete search history.

(56) References Cited

U.S. PATENT DOCUMENTS

| | | | | |
|---|---|---|---|---|
| 3,973,073 | A * | 8/1976 | Barbe | D01D 5/32 428/370 |
| 4,117,194 | A * | 9/1978 | Barbe | D01F 8/14 264/172.14 |
| 5,687,587 | A | 11/1997 | Michel | |
| 6,164,092 | A | 12/2000 | Menaker | |
| 6,776,014 | B1 | 8/2004 | Laycock et al. | |
| 7,040,124 | B1 | 5/2006 | Miller, III et al. | |
| 7,143,790 | B2 | 12/2006 | Liao | |
| 7,299,828 | B2 | 11/2007 | Liao | |
| 7,797,968 | B2 | 9/2010 | Chuang et al. | |
| 8,536,076 | B1 | 9/2013 | Byles | |
| 2002/0013111 | A1* | 1/2002 | Dugan | D01F 8/14 442/335 |
| 2011/0133011 | A1* | 6/2011 | Lee | B65H 51/015 242/166 |
| 2012/0100351 | A1 | 4/2012 | Covelli et al. | |
| 2016/0251782 | A1* | 9/2016 | Liao | D04B 1/18 66/202 |
| 2016/0265146 | A1* | 9/2016 | Liao | D04B 1/18 |
| 2018/0002839 | A1* | 1/2018 | Liao | D02G 3/32 |

FOREIGN PATENT DOCUMENTS

| | | | |
|---|---|---|---|
| WO | WO2013148659 | A1 | 10/2013 |
| WO | WO2015057697 | A1 | 4/2015 |

* cited by examiner

*Primary Examiner* — Danny Worrell

(57) ABSTRACT

The present invention is directed toward an article of apparel formed of a textile having a knit structure (e.g., a circular knit structure) including a base strand and an effect strand. The base strand is inelastic. The effect strand, while inelastic, is modified to be resilient. The base strands are inserted at selected course locations within the knit structure. With this configuration, the knit structure possesses stretch and recovery properties. The resulting knit fabric may be utilized to make underwear (e.g., socks), top-weight garments (e.g., T-shirts), etc.

12 Claims, 4 Drawing Sheets

ARTICLE OF APPAREL

CROSS REFERENCE TO RELATED APPLICATIONS

The present invention claims priority to Provisional Application No. 62/158,706, filed 8 May 2015 and entitled "Article of Apparel," the disclosure of which is incorporated herein by reference in its entirety.

FIELD OF THE INVENTION

The present invention is directed toward an article of apparel and, in particular, a garment having a knit structure including strands that generate stretch within the structure.

BACKGROUND OF THE INVENTION

Circular knit fabric is often used to form articles of apparel. One benefit of a garment formed of circular knit fabric is its comfort resulting partially from the fabric structure's ability to stretch. When a force is applied, the circular knit fabric stretches slightly due to the compression and/or elongation that occurs among the stitches/loops of the fabric. Even when knit fabrics are constructed of only non-elastic, hard yarns (such as cotton, polyester, nylon, acrylics or wool) the stitches/loops will recover when the force is removed. The degree of stretch, however, is limited. The recovery, moreover, is incomplete because hard yarns, which are not elastic, do not provide a recovery force sufficient to rearrange the stitches/loops.

Accordingly, to improve recovery performance, it is common to braid a small amount of elastic fiber onto the hard yarn. One such elastic fiber, elastane, provides the knit structure with a higher stretch level (amount of elongation) and better recovery power (degree to which fabric returns to its original shape/dimensions). Even with elastane integrated into the knit fabric, the fabric does not quickly recover to its original size and shape. Sagging will develop within the garment over time, caused by the incomplete recovery within the structure. Elastane, moreover, retains water, potentially creating wearer discomfort. In addition, since elastane must be braided onto an existing yarn, its use increases the weight of the textile.

Thus, it would be desirable to provide a knitted article including hard yarns that possesses good stretch and recovery, and minimizes or eliminates the use of elastic fibers such as elastane.

BRIEF SUMMARY OF THE INVENTION

The present invention is directed toward an article of apparel formed of a textile having a knit structure (e.g., a circular knit structure) including a base strand and an effect strand. The base strand is inelastic. The effect strand, while inelastic, is modified to be resilient. The base strands are inserted at selected course locations within the structure. With this configuration, the knit structure possesses good stretch and recovery. The resulting knit fabric may be utilized to make underwear (e.g., socks), top-weight garments (e.g., T-shirts), etc.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

The textile is formed via knitting. Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops. In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the strands running continuously around the fabric. With a flat knitting machine, the fabric is produced in flat form, the threads alternating back and forth across the fabric. The resulting textile includes an interior side (the technical back) and an exterior side (the technical face), each layer being formed of the same or varying strands and/or stitches. By way of example, the knit structure may be a single knit/jersey fabric, a double knit/jersey fabric, and/or a plated fabric (with yarns of different properties are disposed on the face and back).

The textile may be formed via weft knitting, where one continuous thread runs crosswise in the fabric making all of the loops in one course. Preferably, the weft knitted textile is formed via circular knitting, in which the textile is produced in the form of a tube, with the threads running continuously around the textile.

Figure 1:
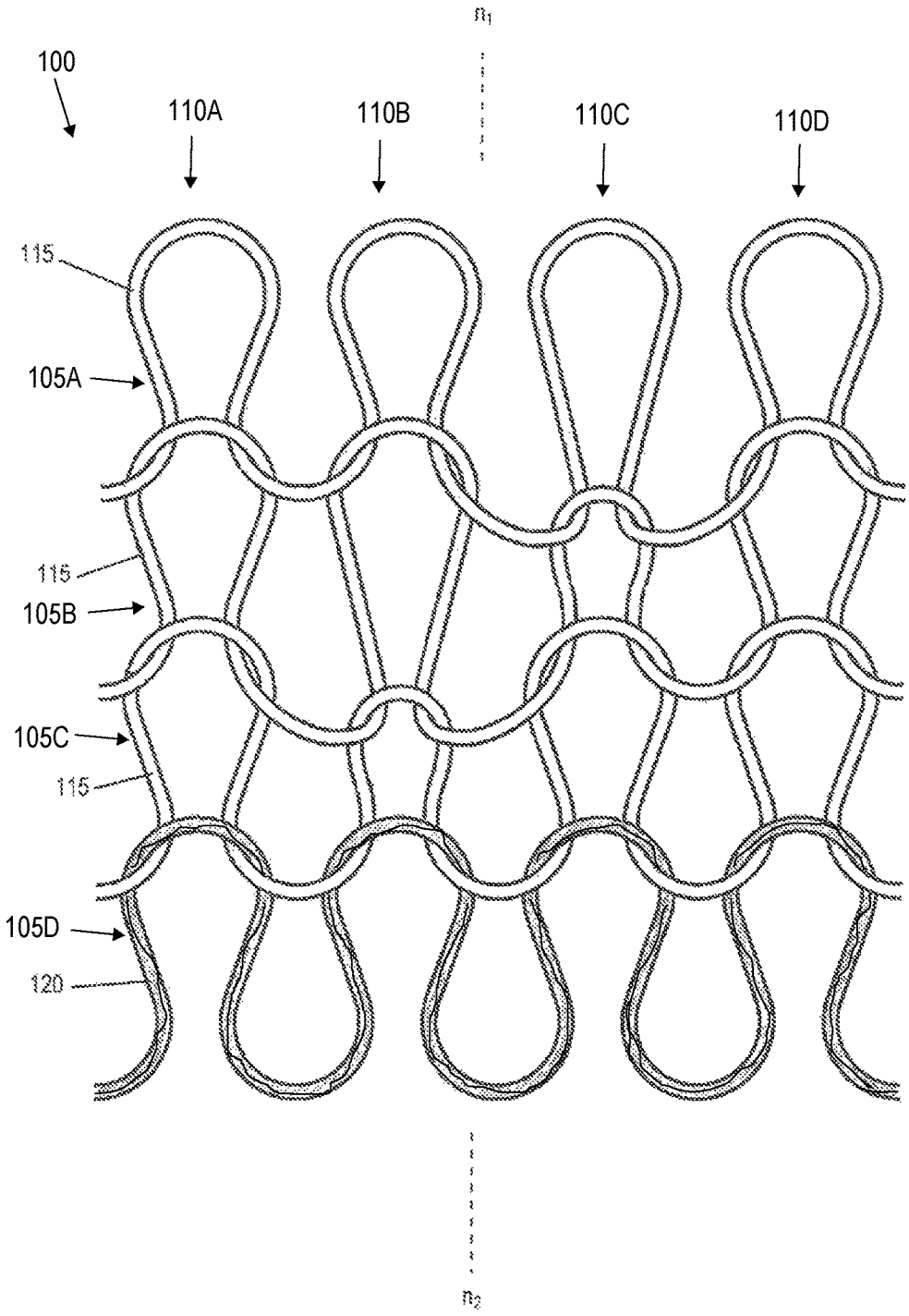
FIG. 1 illustrates a knit textile structure in accordance with an embodiment of the invention.

Referring to FIG. 1, the textile possesses a knit structure 100 organized in courses 105A, 105B, 105C, 105D and wales 110A, 110B, 110C, 110D, each course being formed by a strand. The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). In a preferred embodiment, a strand is a yarn (a continuous strand of textile fibers, filaments, or material in a form suitable for knitting, weaving, or otherwise intertwining to form a textile fabric). A yarn may include, but is not limited to, a number of fibers twisted together (spun yarn), a number of filaments laid together without twist (a zero-twist yarn), a number of filaments laid together with a degree of twist, and a single filament with or without twist (a monofilament). In a preferred embodiment, the yarn is a spun yarn.

In the embodiment, the knit structure 100 includes only inelastic strands. Inelastic strands are not formed of elastomeric material; consequently, inelastic strands possess no inherent stretch and recover properties. Hard yarns are a type of inelastic strand. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly (ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

This is in contrast with conventional textiles, which include an elastic strand. An elastic strand is formed of elastomeric material; consequently, by virtue of its composition, the strand possesses inherent stretch and recovery properties. Elastomeric material includes anidex, elastoester, bi-constituent filament rubber, and combinations thereof. By way of specific example, elastane, a manufactured fiber in which the fiber-forming substance is a long chain synthetic polymer composed of at least 85% of segmented polyurethane, is often utilized.

In an embodiment, the knit structure 100 includes a first, base or ground strand 115 and a second, effect or resilient strand 120. As shown, the base strand 115 forms a plurality of courses 105 within the knit structure 100 and, in particular, a plurality of successive courses 105. The base strand 115, being inelastic, does not possess any stretch and recovery properties.

The effect strand 120 is an inelastic strand modified to provide a predetermined amount of stretch and recovery to the knit structure 100. In an embodiment, the effect strand 120 includes a bicomponent strand including a coiled structure. A bicomponent strand includes two or more polymer types arranged in sheath-core or side-by-side (bilateral) relation. In an embodiment, the bicomponent strand is formed of two polymers of differing properties oriented side-by-side. By way of example, one portion of the fiber may be formed of a polymer possessing a first shrinkage rate (when exposed to wet or dry heat) and a second portion of the fiber may be formed of a polymer possessing second shrinkage rate (e.g., a rate that differs from the first shrinkage rate). With this configuration, when the strand is exposed to heat, the segments shrink at different rates, causing the fiber/filament to become textured and, in particular, to crimp or coil.

The effect strand 120 may possess a recoverable stretch of at least 75%, preferably at least 100%, and more preferably up to 150% or more (per, e.g., ASTM D6720-07)). In an embodiment, the effect strand 120 recovers rapidly and substantially to its original length when stretched to one and half times its original length (150%) and released.

Figure 2:
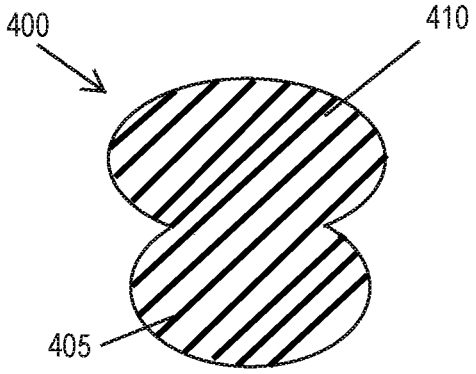
FIG. 2 is a schematic of a cross sectional view of a bicomponent fiber according to an embodiment of the invention.

In an embodiment, the bicomponent strand is a polyester bicomponent fiber/filament. A polyester bicomponent filament is a continuous, bilateral filament including two different polyesters intimately adhered to each other along the length of the filament. That is, the bicomponent filament is a unitary structure, with the polyester pair being integrated along the filament length. Referring to FIG. 2, the filament 400 includes a first polyester 405 mated with a second polyester 410. The polyester bicomponent filament comprises poly(trimethylene terephthalate) and at least one polymer selected from the group consisting of poly(ethylene terephthalate), poly(trimethylene terephthalate), and poly (tetramethylene terephthalate) or a combination thereof. Upon heating, each polyester 405, 410 contracts (shrinks) at a different rate from the other polyester, causing the filament to form a helical coil. The polyester bicomponent filaments include poly(ethylene terephthalate) and poly(trimethylene terephthalate) in a weight ratio of about 30/70 to about 70/30, and have an after-heating contraction value from about 20% to about 80%, and preferably about 30% to about 60%

In a preferred embodiment, the first polyester segment 405 is a 2GT type polyester polyethylene terephthalate (PET) and the second polyester segment 410 is a 3GT type polyester (e.g., polytrimethylene terephthalate (PTT)). In an embodiment, the 2GT type polyester forms about 60 wt % of the filament, while the 3GT type polyester forms about 40 wt % of the filament.

The bicomponent strand may generally symmetrical, with each segment 405, 410 possessing of similar volume mass. Alternatively, the bicomponent strand may be asymmetrical, with one segment of the strand (e.g., the first polyester 405) possessing more volume or mass than the second segment (e.g., the second polyester 410).

As noted above, when exposed to heat, the first strand segment 405 shrinks at a different rate than the second strand segment 410, producing a regular, helical coil in the strand. The helical coil generates non-elastomeric, mechanical stretch and recovery properties within the yarn. Accordingly, while the effect strand 120 is inelastic, it is resilient. This is in contrast with the base strand, which is not resilient.

In an embodiment, the knit structure 100 includes effect strands 120 disposed at predetermined locations within the knit structure. By way of example, one effect strand 120 may be oriented in spaced relation from an adjacent effect strand, with the remaining courses formed by base strands 115. In general, the effect strand 120 may form approximately every second course 105 to approximately every eleventh course 105 (e.g., the effect strand is placed every $4^{th}$-$10^{th}$ course). Preferably, the effect strand 120 forms every fourth, fifth, or sixth course 105 within the knit structure 100. Typically, the spacing remains consistent throughout the knit structure 100. In other embodiments, the spacing of the effect strand 120 may be varied to alter the recovery and/or stretch properties throughout the textile. By way of specific example, the effect strand 120 may form every fourth course 105 of the garment along the chest of a shirt, but form every sixth course along the sleeves.

In another embodiment, the effect strands 120 form the entire knit structure (i.e., all strands forming the textile or apparel are effect strands).

In a further embodiment, each effect strand 120 is paired with a corresponding base strand 115 (e.g., the strands are braided or otherwise commingled). The strand pair is then utilized to form courses 105 within the knit structure 110.

With either configuration, the amount of the effect strand 120 in the knit structure is about 20% to about 100% (e.g., about 25% to about 75%). Stated another way, the ratio of base strand 115 to effect strand 120 within the knit structure 100 may be about 4:1 to about 1:4. By way of specific example, the structure/garment may include 22% polyester bicomponent fiber and 78% cotton fiber.

With the above described configurations, an article of apparel is provided that, while being formed solely of inelastic strands and lacking any elastic strands, still possesses stretch and recovery properties. This is in contrast with conventional textile structures, which require elastane, braiding it onto a strand forming a course.

In addition to providing stretch and recovery properties to the knit structure 100 (and thus the textile), placing effect strands within the structure modulates the temperature along the skin surface by forming an uneven or undulating surface. Similarly weighted base 115 and effect 120 strands possess different degrees of loft, with the effect strand possessing greater loft than the base strand. Stated another way, the base strand 115 and the effect strand 120, while possessing the same weight, possess different diameters, with the effect strand possessing a larger diameter than the base strand. As a result, the effect strands 120 may protrude from the surface of the textile.

Figure 3:
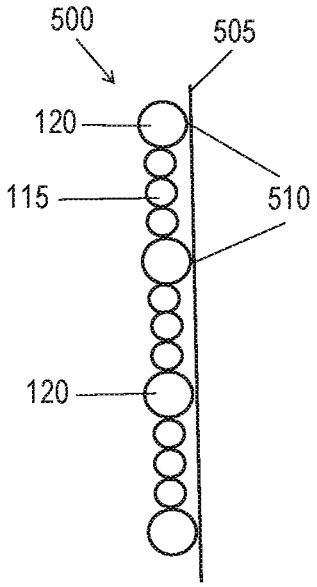
FIG. 3 is a schematic showing (in exaggeration) a cross sectional view of the courses of the textile structure including base and effect strands.

Referring to FIG. 3, through selective placement of effect strands, the surface of the textile 500 (and thus the garment) is spaced from the user (e.g., from the skin 505 of the user). The only contact points 510 of the fabric are the effect strands 120. Spacing the garment away from the user (e.g., spacing approximately 2 mm) encourages airflow, increasing wearer comfort. When the effect strands 120 are polyester bicomponent fibers, moreover, the effect strands possess a low water retention property. That is, any moisture from the wearer (e.g., sweat) contacts the polyester bicomponent fibers, the moisture is drawn quickly through the fiber and dispersed along throughout the base strands 115, which are not in contact with the user, as well as exhausted to the ambient environment. Since wet fibers are not in continuous contact with user, the comfort level of the article of apparel is improved.

Figure 4:
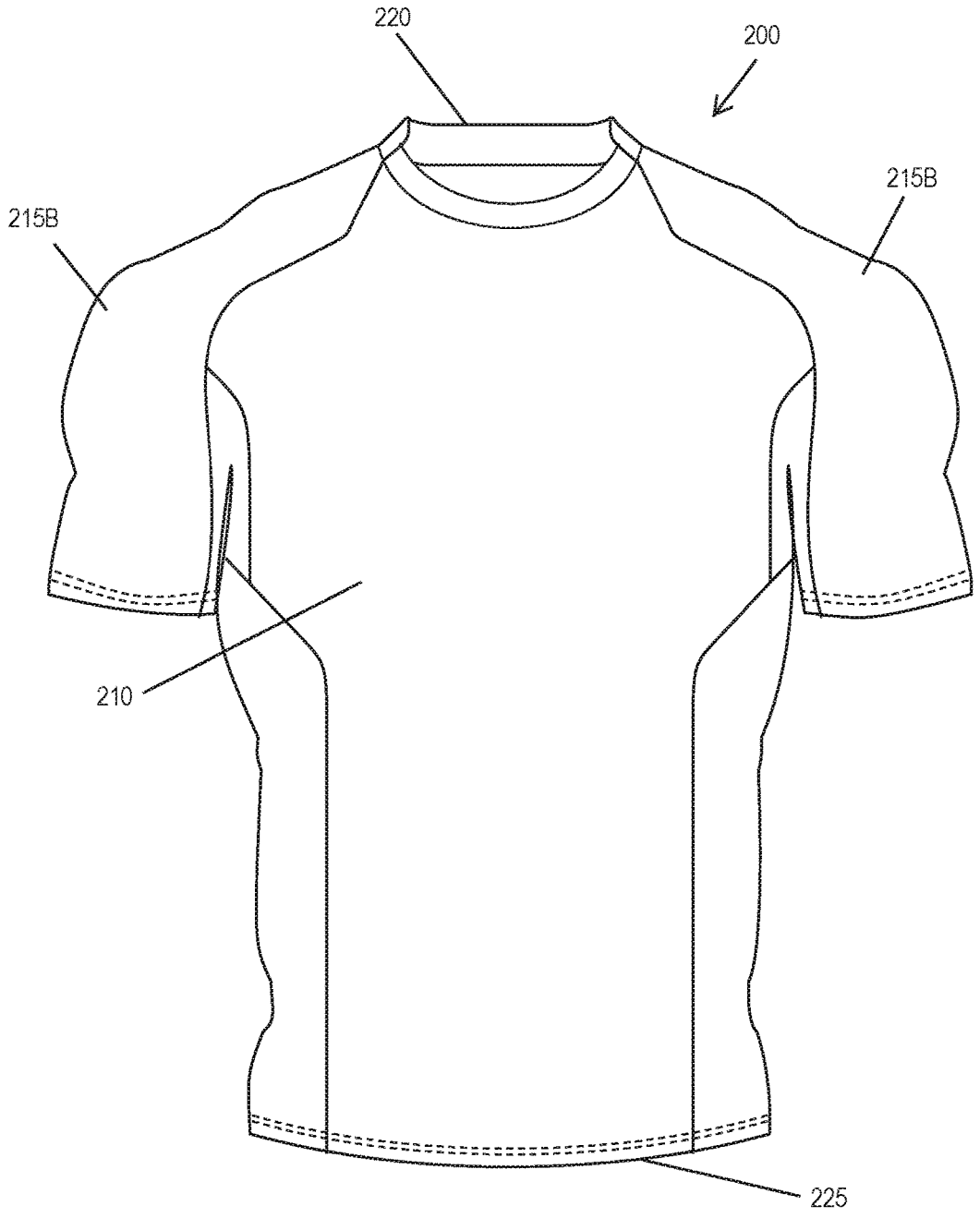
FIG. 4 illustrates an article of apparel including the knit textile structure of FIG. 1.

The resulting knit structure 100 is incorporated into an article of apparel. Referring to FIG. 4, the article of apparel 200 may be in the form of a short-sleeved shirt including a torso portion 210, arm sleeves 215A, 215B, an upper neck opening 220, and a lower waist opening 225. Tubular knit fabrics are fabrics that are knit in the desired three-dimensional configuration as opposed to two-dimensional fabrics that are cut, sewn and otherwise manipulated to create a three-dimensional configuration. It should be understood, however, that the article of apparel 200 may have the configuration of other tubular garments, including various short or long-sleeved shirts, tank tops, undershirts, jackets, or coats; pants, trousers or shorts; socks, nylons or other leggings; dresses or skirts; hats and other headgear; etc.

Figure 5:
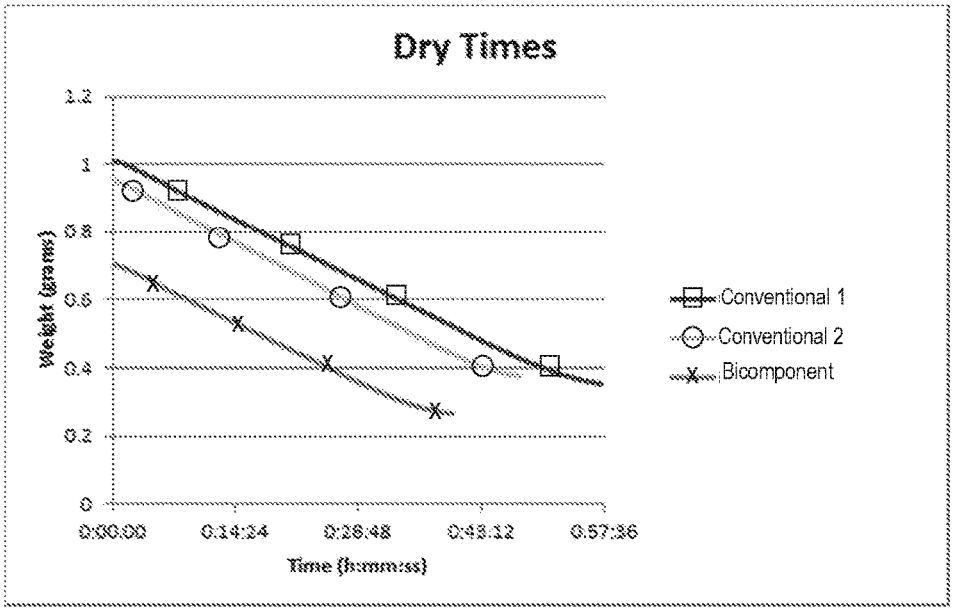
FIG. 5 illustrates a graph comparing an article of apparel formed of the inventive textile structure to articles of apparel including prior art textile structures.

The resulting structure is lighter, dries faster, and/or is more breathable than textile structures having similar stretch values achieved via an elastomeric strand. Referring to FIG. 5, the inventive shirt was tested against two conventional shirts including a resilient strand (e.g., elastane) providing similar stretch properties to the garment. As shown in the graph, the inventive shirt, including spun polyester as the base strand 115 and a bicomponent polyester as the effect strand 120 disposed at every fourth course (i.e., about 25% bicomponent fiber), was not only lighter in weight, but dried in less than the comparable conventional shirts, each of which included approximately 5% spandex. In the graph, convention shirt #1 included 95% cotton fiber and 5% elastance fiber. Conventional shirt #2 included 60% cotton and 40% polyester and 5% elastane (plaited).

While the invention has been described in detail and with reference to specific embodiments thereof, it will be apparent to one skilled in the art that various changes and modifications can be made therein without departing from the spirit and scope thereof.

For example, the resulting effect strand 120 may possess any count suitable for its described purpose (incorporation into textile structure forming an article of apparel). The term count is a numerical designation of yarn size indicating the number of wales and courses per inch in a knit fabric. In a preferred embodiment, the count is about 40/1 (e.g., 40.05/1).

The resulting effect strand 120 may possess any twist suitable for its described purpose. Twist is the number of turns about its axis per unit of length of a yarn or other textile strand. Twist is expressed as turns per inch (tpi), turns per meter (tpm), or turns per centimeter (tpcm). In a preferred embodiment, the twist of the effect strand yarn is 20.61 turns per inch.

The resulting effect strand 120 may possess any twist direction suitable for its described purpose. The direction of twist in yarns and other textile strands is indicated by the capital letters S and Z. Yarn has S-twist if when it is held vertically, the spirals around its central axis slope in the same direction as the middle portion of the letter S, and Z-twist if they slope in the same direction as the middle portion of the letter Z. In a preferred embodiment the direction of twist of effect strand yarn is a Z twist.

The base strand 115 or the effect strand 120 may possess any denier suitable for its described purpose (incorporation into the textile structure of an article of apparel). Denier is a relative measure of a linear density (or fineness) of a fiber or yarn (i.e., weight-per-unit-length measure of any linear material). It is the number of unit weights of 0.05 grams per 450-meter length. This is numerically equal to the weight in grams of 9,000 meters of the material. In an embodiment, the base and/or effect strand may possess a denier of approximately 15-600, e.g., approximately 150.

The effect strand 120 may be the dominant strand within a course. For example, other fibers may be plaited onto the effect strand. The course itself, however, may include at least 50% by weight effect strand 120.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed is:

1. An article of apparel for a torso, the article of apparel comprising a knit structure including a plurality of strands organized in courses and wales, the knit structure including a first strand and a plurality of second strands, each second strand of the plurality of second strands being separated from an adjacent second strand by the first strand, wherein:

the first strand is an inelastic strand, the second strand is configured to stretch a predetermined amount from a normal position to a stretched position, the second strand is a bicomponent strand comprising a first polymer segment formed integrally with a second polymer segment, the first and second polymer segments are arranged in side-by-side relation, the first polymer segment possesses a first rate of shrinkage, the second polymer segment possesses a second rate of shrinkage, and the first rate of shrinkage is greater than the second rate of shrinkage.

2. The article of apparel according to claim 1, wherein the first strand forms a first course of the knit structure and the second strand forms a second course of the knit structure.

3. The article of apparel according to claim 1, wherein a single course in the knit structure includes the first strand and the second strand.

4. The article of apparel according to claim 1, wherein the knit structure includes a plurality of first strands.

5. The article of apparel according to claim 1, wherein:

the bicomponent strand is a bicomponent polyester filament;

the first polymer segment is comprises poly(trimethylene terephthalate); and the second polymer segment comprises at least one polymer selected from the group consisting of poly(ethylene terephthalate), poly(trimethylene terephthalate), and poly(tetramethylene terephthalate).

6. The article of apparel according to claim 1, wherein the first strand includes a natural yarn, a synthetic yarn, or a combination thereof.

7. The article of apparel according to claim 6, wherein the natural yarn is cotton yarn and the synthetic yarn is polyester yarn.

8. The article of apparel according to claim 1, wherein:

the article of apparel comprises a torso portion, an upper neck opening, and a lower waist opening;

the torso portion comprises the knit structure.

9. The article of apparel according to claim 1, wherein the knit structure is a circular knit structure.

10. The article of apparel according to claim 1, wherein at least one second strand of the plurality of second strands possesses a larger diameter than the first strand.

11. The article of apparel according to claim 1, wherein the second strand is a non-elastomeric strand.

12. The article of apparel according to claim 1, wherein the second strand is further configured to recover, moving from the stretched position toward the normal position.

* * * * *